United States Patent [19]

Larkin et al.

[11] 4,115,954

[45] Sep. 26, 1978

[54] REMOTELY OPERATED GATE STRUCTURE

[76] Inventors: Mark E. Larkin, 419 Northgate, Lindenhurst, Ill. 60046; Michael H. King, P.O. Box K, R.R. 3, Scottsburg, Ind. 47170

[21] Appl. No.: 746,512

[22] Filed: Dec. 1, 1976

[51] Int. Cl.[2] ..... E05D 7/06

[52] U.S. Cl. ..... 49/240; 49/265; 49/280; 49/386

[58] Field of Search ..... 49/240–245, 49/199, 263, 265, 280, 386

[56] References Cited

U.S. PATENT DOCUMENTS

| | | | |
|---|---|---|---|
| 861,831 | 7/1907 | Haile | 49/240 |
| 1,186,738 | 6/1916 | Boudreau | 49/241 |
| 3,397,488 | 8/1968 | Goldstein | 49/199 |

FOREIGN PATENT DOCUMENTS

| | | | |
|---|---|---|---|
| 536,541 | 5/1941 | United Kingdom | 49/240 |
| 289,158 | 4/1928 | United Kingdom | 49/240 |

*Primary Examiner*—Kenneth Downey
*Attorney, Agent, or Firm*—Robert J. Lewis

[57] ABSTRACT

A gate structure is provided whch is openable from a remote position and includes a pair of spaced apart supports on one of which is mounted a hinge arrangement having a pair of spaced apart hinged members which are movable relative to one another and in turn hingedly mount a gate on a support. Power means is provided and is operably connected to the hinge means to effect the relative movement of the hinge members whereby upon relative movement the gate is tilted and the free end thereof is raised so that the gate will open under the influence of gravity. The power means is selectively operated by motive means which is operably connected to actuator means by an energy transmitting member which is substantially immovable during the transmission of energy from the motive means to the actuator means. Latch means is provided which releasably retain the gate in its closed position and when the free end of the gate is raised the latch means will release the gate so that same can move to an open position.

21 Claims, 9 Drawing Figures

REMOTELY OPERATED GATE STRUCTURE

It has long been a problem in the use of gates and like structures that when operation is desired, such as a farm gate, the operator must leave a vehicle, walk to the gate, unlatch same and move it to an open position, reenter the vehicle, drive through the gate opening and then once again return to the gate after leaving the vehicle a second time, close the gate and latch same before he can continue on. Attempts have been made in the past to provide a self-opening gate which would not require an operator to leave a vehicle. Although these structures made an advance in the art, they were plagued with problems. Typical of this type of gate was a gate which was hingedly mounted on a support post whereby the gate was operably connected to a rigid mechanical link which could be operated from a position remote from the gate. This could either be done by the use of a lever connected to the link or by an actuator resting on the ground which could be run over by a vehicle to effect opening of the gate. This type of structure used upper and lower hinges which were relatively movable to one another to shift the gate so that same would open under the influence of gravity. One problem with such structures is that the mechanical link had to be exposed thereby subjecting same and the operation of the gate to weather conditions and damage by vehicles or animals or weather. In the winter, such structures would have to be maintained free of snow and ice so that same would function properly. Also, for use in farm installations such mechanical links could pose injury problems to animals.

The present invention provides an improved gate structure and means for opening same which overcomes the above enumerated difficulties by providing an actuator means which is operably connected to hinge means with the actuator being operable from a remote position by motive means which is operably connected to the actuator by an energy transmitting member which is normally immovable, i.e., movement is not required to transmit energy to effect operation of the actuator means. This can be done by either hydraulic means or electrical means whereby hydraulic lines can be buried underground as can be an electrical conductor.

The principal objects and advantages of the present invention are: to provide an improved gate structure and means for operating same to eliminate the need for an operator to leave a vehicle to effect operation of the gate; to provide such a structure wherein an energy transmission member need not move during the transmission of energy to an actuator to effect opening of the gate; to provide such a structure with a latch to retain the gate in a closed position which works automatically for unlatching and relatching of the gate during opening and closing movements; to provide such a structure which is operable in all types of weather and not subject to inoperability due to adverse weather conditions; to provide such a structure which requires a minimum amount of energy to effect opening and closing of the gate; to provide such a structure which in certain forms does not require an external energy source from a distant source of energy; to provide such a structure which provides improved hinged mounting of one end of the gate; to provide such a structure with means for reducing impact of the gate upon completing opening movement and with means to help induce closing movement of the gate after the opening movement; to provide such a structure which is adapted to facilitate commencing of the opening movement; and to provide such a structure which is well adapted for its intended use and simple to operate and maintain.

Other objects and advantages of the present invention will become apparent from the following detailed description taken in connection with the accompanying drawings wherein are set forth by way of illustration and example certain embodiments of the present invention.

Figure 1:
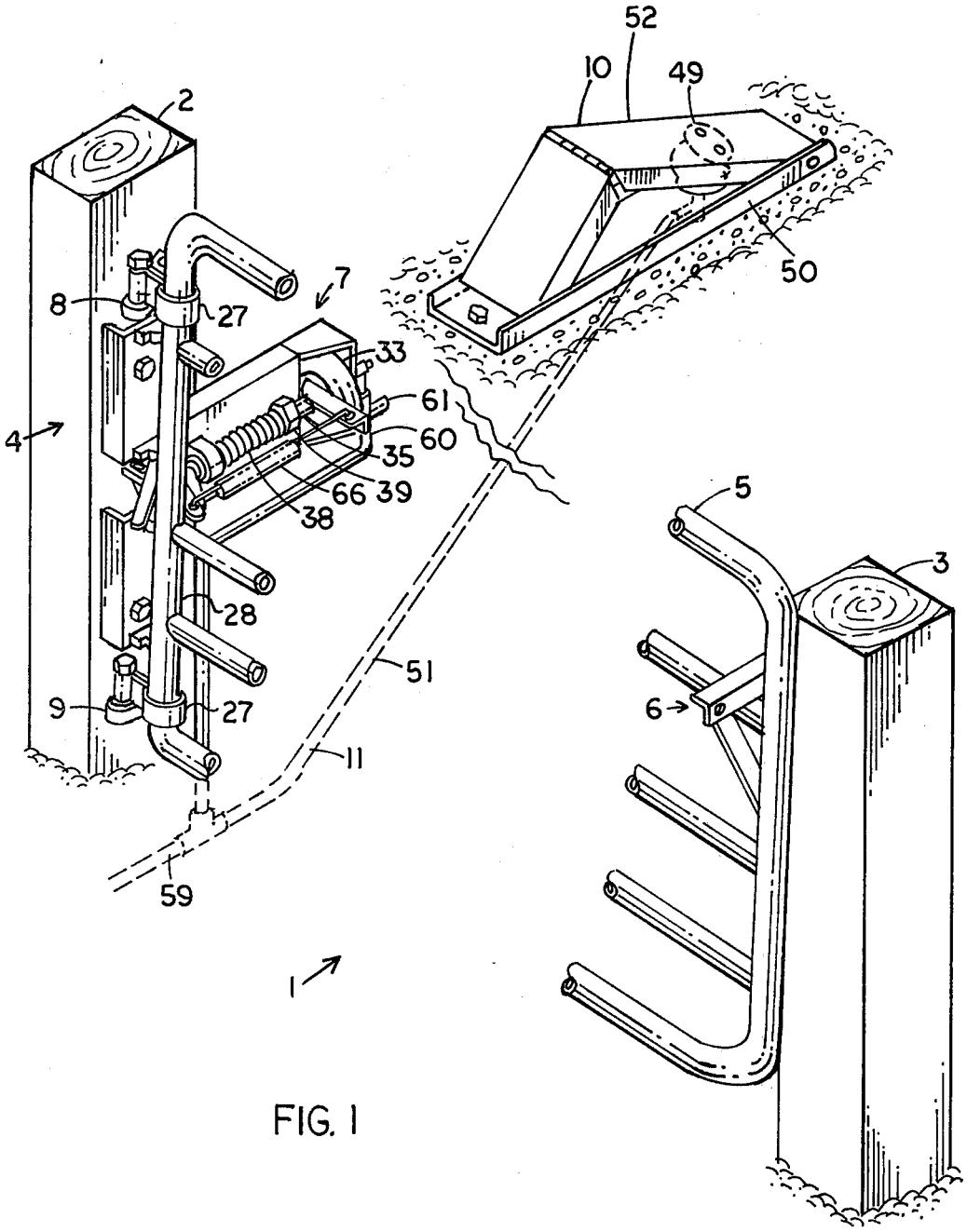
FIG. 1 is a perspective view of a gate structure and means to effect opening and closing movement thereof with portions shown out of proportion and position.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriate detailed structure.

The reference numeral 1 designates generally a remotely operable gate structure which includes a support post 2 and a latch post 3 which are in spaced apart relation. The support post 2 has secured thereto hinge means 4 which hingedly mounts on the post 2, a gate 5 which can be of any suitable structure having a free end thereof movable toward and away from the post 3. Latch means 6 is secured to the post 3 and is operable to releasably retain the free end of the gate adjacent to the post 3. Actuator means 7 is operably connected to the hinge means 4 to effect movement of hinge members 8 and 9 which are portions of the hinge means 4 wherein the hinge members 8 and 9 move relative to one another and are in generally vertically spaced relation. Motive means 10 is also provided wherein at least a portion of the motive means can be at a position remote from the gate with the motive means 10 being operably connected to the actuator means 7 by an energy transmitting member 11 which does not require movement to effect transmission of energy to the actuator means to thereby effect movement of the hinge members 8 and 9 relative to one another which in turn effects movement of the gate 5 under the influence of gravity, there can also be provided a stop member (not shown) such as a post on the side of the gate 5 to which same will move to an open position wherein the post (not shown) can provide a positive stop for opening movement of the gate.

In the illustrated structure, the hinge means 4 includes a pair of shafts 15 and 16 which are rotatably mounted on the post 2 as, for example, by each shaft being rotatably mounted in bearings 18 which are secured to the post 2 in a suitable manner. As shown, the bearings 18 are secured to mounting brackets 19 which are in turn secured to the post 2 in a suitable manner such as by screws 20. It is to be noted that although in the form shown there are two shafts which are rotatably mounted, it is to be understood that the structure will still be operable with only one rotatably mounted shaft so long as the hinge members 8 and 9 are movable relative to one another. This can be accomplished by effecting movement of only one of the hinges. In the illustrated structure, the hinges 8 and 9 are each secured to an end of the respective shaft 15 and 16 in any suitable manner. Preferably each of the hinges includes an arm 22 which is releasably secured to the respective shaft as, for example, by having an opening 23 therethrough with the shaft being received therein. A slot 24 is provided to provide for expansion of the opening 23 so that the arm 22 can be moved longitudinally along the respective shaft so that the hinge means 4 is adjustable to accommodate for different sizes of gates. Preferably, the arms 22 are keyed to the respective shaft so as to prevent relative rotation therebetween. The arms 22 are clamped onto the respective shaft as, for example, by having a screw 25 mounted thereon to effect tightening of the arm 22 onto the respective shaft. Second hinge arms 27 are each secured to a portion 28 of the gate 5 and extend therefrom and are pivotally connected to the respective arm 22 as, for example, by bolt and nut 29, which secures hinge arms 27 to a multiaxis bearing 31 such as spherical bearing. Preferably, the spherical bearing 31 is suitably secured in each of the arms 22 and receives therethrough the respective bolt 29 for connecting the arm 27 to the arm 22. By use of the spherical bearings 31, multiaxis pivoting and swinging of the gate 5 can be accomplished and still provide a hinge arrangement which is free of play and still allows freedom of movement in multiaxis. In a preferred embodiment, the upper arm 22 is disposed angularly to the lower arm 22 as, for example, same are disposed about 40° relative to one another in a plane generally normal to the longitudinal axis of the shafts 15 and 16. The purpose for this will be more fully described hereinbelow.

Figure 4:
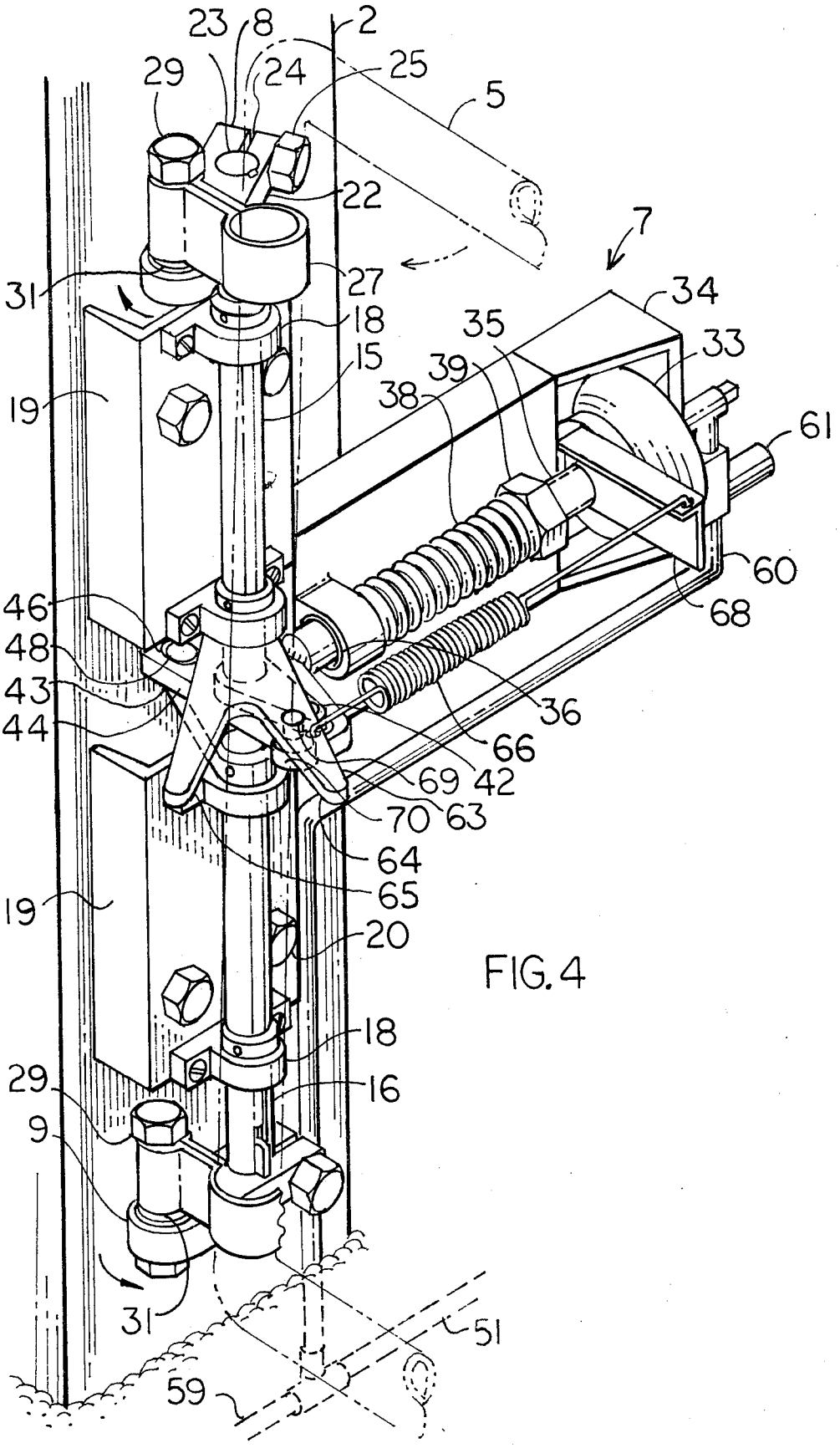
FIG. 4 is an enlarged fragmentary perspective view of an actuating portion of the gate opening means with a gate portion shown in broken lines to show structural details thereof.

Any suitable power actuator means 7 can be provided to effect the relative movement of the hinges 8 and 9. In a preferred form, as best seen in FIG. 1 and FIG. 4, the actuator means includes an extendable hydraulic member 33 such as a "Firestone Airstroke Actuator" which is a flexible resilient member which when pressurized by the action of fluid, extends in a generally linear direction. The hydraulic member 33 as shown is secured to a bracket 34 which in turn is secured to the post 2. Preferably, a shaft 35 is secured to the hydraulic member 33 and is movable thereby and as shown the shaft 35 is slidably received in a bearing 36 which is secured to the bracket 34 so that the shaft 35 moves in a generally linear path. Means is provided to return the hydraulic member 33 to a collapsed or retracted position and as shown the means includes a spring 38 mounted on the shaft 35 with the shaft 35 preferably having a threaded portion with a nut 39 in threaded engagement therewith so as to provide a means to adjust spring pressure to effect retraction of the hydraulic member 33. The shaft 35 has a free end 40 which has mounted thereon, in a suitable manner, a pair of arms 42 and 43. In the structure shown, this mounting is accomplished by having a plate 44 secured to the end of the shaft 35 as, for example, by welding with the arms 42 and 43 being in pivotal relation with and on opposite sides of the plate 44 as, for example by having needle bearings 47 and 48, respectively, received in elongate slots 46 in the plate 44. In the embodiment shown, the arm 42 is secured to the shaft 15 and the arm 43 is secured to the shaft 16 in any suitable manner. By the connection of the actuator member 33 to the shafts 15 and 16 expansion of the hydraulic member 33 effects pivoting movement of the arms 42 and 43 and rolling action of needle bearings in elongated slots 46 and hence rotation of the shafts 15 and 16 to effect relative movement of the hinge members 8 and 9.

The hydraulic member 33 is connected to motive means 10 by the energy transmitting member 11. In operation, the energy transfer member 11 does not require movement for the transmission of energy from the motive means to the actuator means. Preferably, the energy transfer member includes a conduit means 51 which can be buried underground. As shown, in the preferred embodiment, the motive means includes a hydraulic member 49 which can be similar to the hydraulic member 33 and means is provided to effect expansion and contraction of the hydraulic member 49. In the illustrated form, the hydraulic member 49 is secured to a base 50 which is in the form of a channel and has hingedly mounted thereon a ramp 52 which is hingedly mounted as, for example, by a hinge 53. Preferably, the ramp 52 is a channel member and is secured to one end of the hydraulic member 49. A portion 54 of the ramp 52 extends beyond the hinge toward an end of the base 50 and has a stop surface 55 engageable with the base to limit upward pivoting movement of an end 56 of the ramp 52. Preferably, the hydraulic member 49 is positioned closer to the hinge 53 than it is to the end 56 for a purpose to be later described. A second member 58 is hingedly mounted on the ramp 52 adjacent the end 56 by a hinge 59 and when the ramp 52 is in the up position the member 58 prevents catching of objects on the end 56. The upstanding sides of the base 50 form a guide for the depending sides of the ramp 52 and member 58 to prevent lateral movement thereof. The conduit means 51 is in flow communication with the hydraulic members 49 and 33 forming a flow path therebetween. The system contains sufficient fluid whereby when the hydraulic member 49 is extended the hydraulic member 33 is retracted and vice versa. Downward movement of the ramp 52 effects contraction or compression of a hydraulic member 49 and extension of the hydraulic member 33 to thereby effect forward movement of the shaft 35 and rotation of the shafts 15 and 16. Release of downward force on the ramp 52 allows the spring 38 to contract or compress the hydraulic member 33 to effect extension of the hydraulic member 49.

A second motive means is provided and is positioned on the opposite side of the gate 5 as the above-described motive means 10 and preferably is similar in construction and operation thereto having a hydraulic member 49 mounted on a base 50 with the respective hydraulic member 49 being connected to the conduit means 51.

The conduit means includes a conduit 59 connected between the hydraulic members 49 and a conduit 60 which is connected to the hydraulic member 33 and the conduit 59 so as to form a flow path between the hydraulic members 49 and 33. Preferably, a flow control valve 61 is connected in the conduit 60 to provide regulated flow of fluid out of the hydraulic member 33. This can be accomplished by using a flow control valve which only restricts flow in one direction and preferably is of an adjustable type. In use it is preferred that the conduits 59 and 60 and the hydraulic members 49 and 33 are filled with a liquid which will not become too viscous or freeze at lower temperatures. Preferably, the fluid is a liquid such as ethylene glycol which can be mixed with water for dilution. In operation, when the gate is in a closed position, the hydraulic member 33 is in a collapsed condition as seen in FIG. 1 and both of the hydraulic members 49 are in an extended position. Downward force on either of the ramps 52 causes the respective hydraulic member to contract thereby displacing the fluid in the conduit system and causing the hydraulic member 33 to expand and move the shaft 35 to an extended position to effect rotation of the shafts 15 and 16 which is effected by pivoting motion of the arms 42 and 43 in slots 46 which because of their arrangement effects rotation of the shafts 15 and 16 in opposite directions. The other hydraulic member 49 cannot extend due to the limited upward movement of the ramp 52. The shaft rotation in turn effects movement of the arms 22 whereby the upper arm 22, say for example, moves in in a clockwise direction as viewed from the top and the lower arm 22 moves in a counterclockwise direction as viewed from the top. In the particular arrangement shown, this movement of the arms 22 effects outward movement of the lower portion of the gate 5 adjacent the post 2 and inward movement of the upper portion of the gate 5 adjacent the post 2 and tilting of the gate 5 by the shifting of the axis of the hinges. The outward movement of the lower portion of the gate effects lifting movement of the free end of the gate and movement of the upper portion of the gate toward the post 2 causes the gate to be tilted to change the plane of the gate and shift the center of gravity whereby the gate is sloped at an angle and gravity induces opening movement of the gate 5. When the downward force is relieved from the ramp 52, the spring 38 applies sufficient force to the hydraulic member 33 to force the fluid therein out and back through the conduit 60 and into the respective hydraulic member 49 to allow the arms 22 to rotate back to their position as seen in FIG. 1 whereby the gate angle is changed so that the gate slopes downwardly so that gravity effects closing movement of the gate. The adjustable valve 61 controls the flow rate of the fluid out of the hydraulic member 33 at a predetermined flow rate so as to allow a vehicle sufficient time to pass through the open gate before the gate has time to close. The nut 39 allows adjustment of the spring compression in the spring 38 so as to accommodate different weights of gates.

Figure 2:
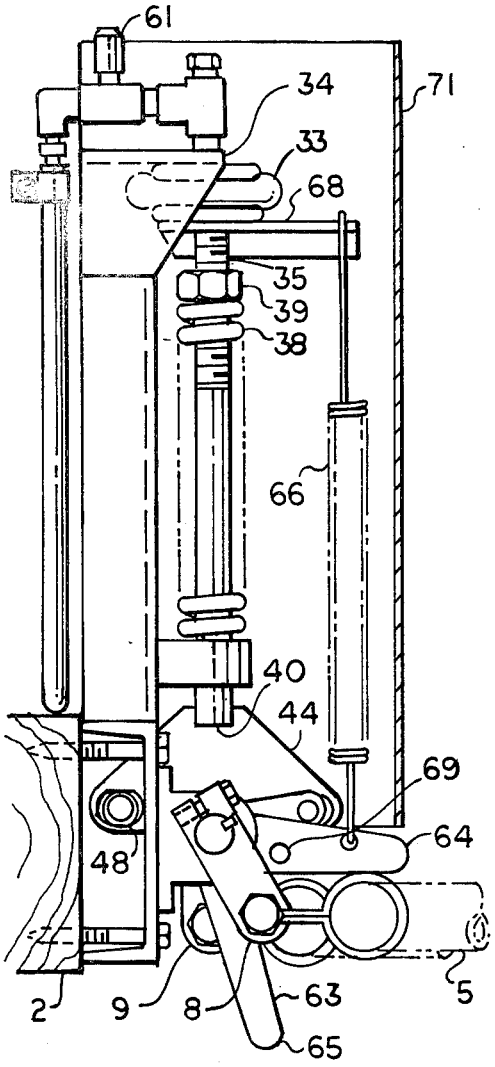
FIG. 2 is an enlarged fragmentary plan view of the hinge means showing the gate, in broken lines, in a closed position.
Figure 3:
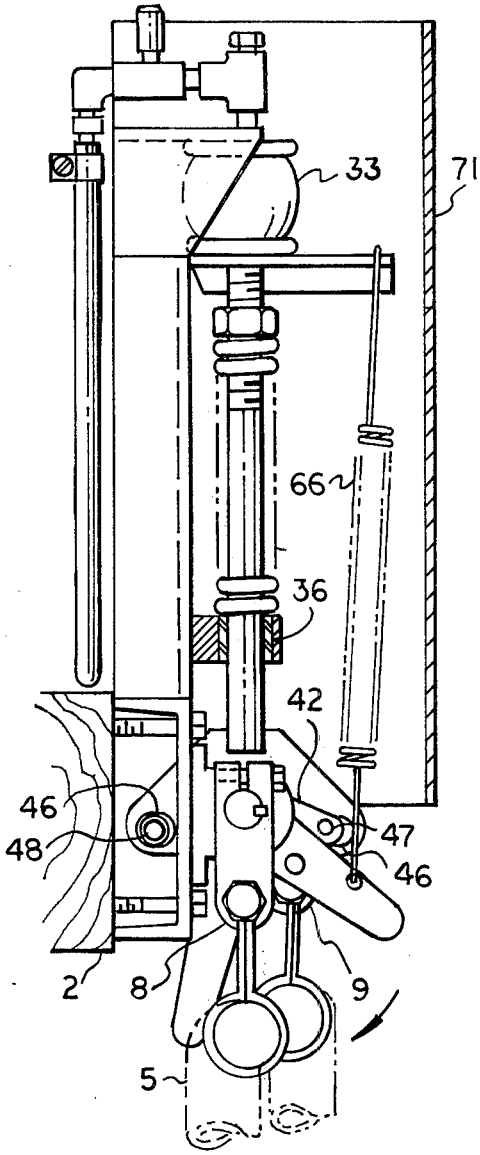
FIG. 3 is an enlarged fragmentary plan view similar to FIG. 2 of a hinged means showing the gate, in broken lines, in an open position.
Figure 6:
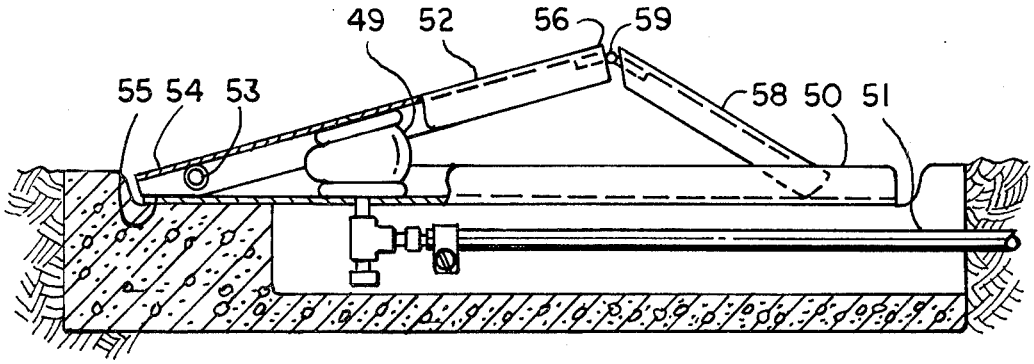
FIG. 6 is a sectional side elevational view of motive means which is a preferred form of the structure.

Means is provided to cushion the final opening movement of the gate 5 and also, preferably means is provided to help induce initial closing movement of the gate 5. In the illustrated structure, the above-described means is a mechanism to effect both results and, as shown, a shock or torque arm 63, having two arm portions 64 and 65, is suitably pivotally mounted, as for example, on the shaft 15 adjacent the arm 42. A resilient member such as a spring 66 is provided to urge the arm 63 to a normal position and to provide a resilience to cushion the final opening movement of the gate 5. As shown, the spring 66 has one end connected to a bracket 68 which is secured to the actuator 33 and movable therewith. The other end is connected to the arm 63. Preferably, a pin 69 which has a bearing 70 thereon which is positioned for selective engagement with means to effect movement thereof. For example, the bearing 70 is positioned for engagement with the plate 44 whereby movement of the plate 44 which is effected by extension of the hydraulic member 33 can help effect positive movement of the arm 63 and hence because of the engagement of the arm portion 64 with the gate 5 a positive initial force can be applied to the gate to help start opening movement thereof to aid or assist in the gravity induced opening movement of the gate 5. As best seen in FIG. 2, the upstanding portion of the gate 5 to which the hinge members are secured is adjacent the arm portion 64. As best seen in FIG. 3, when the gate 5 is reaching its final open position, the upstanding portion of the gate 5 moves into engagement with the arm portion 65 and because torque arm is biased by the spring 66, the final opening movement is retarded due to the resilience of the spring 66 and the force which same applies to the arm 63. The spring 66 also helps induce the initial closing movement of the gate 5 by providing a force acting on the gate in addition to that which gravity applies to the gate when the hinge members are shifted back to their position to effect closing movement of the gate. Because the bracket 68 is movable with the actuator 33 contraction of the actuator lengthens the spring 66 thereby providing additional closing force. Also, a housing 71 (see FIGS. 2 and 3) can be provided to enclose the actuator means 7.

Figure 5:
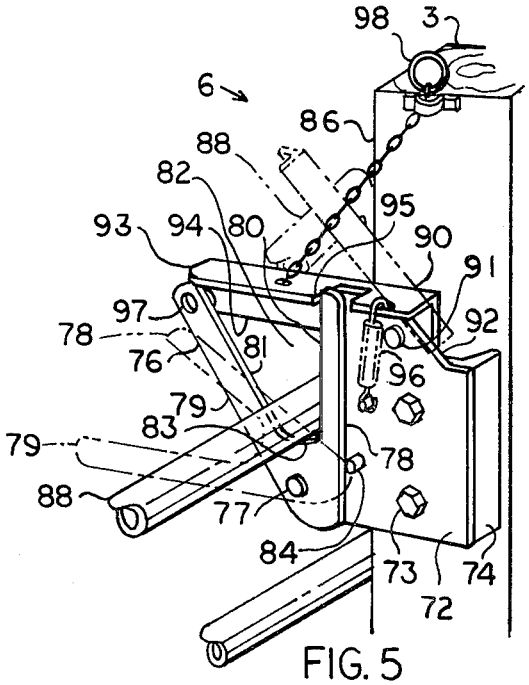
FIG. 5 is an enlarged perspective view of the latch means showing the latch in a latched position in solid lines and the latch in an unlatched position in broken lines.

The latch means 6 can be of any suitable type and preferably is an automatically actuated type which is operable by movement of the gate in response to actuation and movement of the hinged end of the gate. In the illustrated structure, the latch means 6 includes a plate 72 which is secured to the post 3 in any suitable manner as, for example, by screws 73. Preferably, the plate 72 has a channel member 74 positioned between same and the post 3 so that the latch can be readily mounted on either square post or round post and still provide good, rigid securement. The latch means 6 includes a latch member 76 which is pivotally mounted on the plate 72 as, for example, by a suitable pivot such as a pin 77. The latch member 76 in the illustrated structure is comprised of two arms 78 and 79 which have free ends thereof in spaced apart relation with the arms 78 and 79 also being in spaced apart relation wherein respective edges 80 and 81 define a notch or opening 82 therebetween. Also, an edge 83 extends between the arms 78 and 79 and also partially defines the notch 82. Preferably, the arms are in diverging relation and diverge toward the free ends thereof forming an enlarged opening into the notch 82 with the opening being smaller in the direction toward the edge 83. The latch member 76 is movable between a latched position and an unlatched position, with the unlatched position being shown in broken lines in FIG. 5. The latch member 76 is biased to the unlatched position in a suitable manner as for example by positioning the center of gravity relative to the pivot 77 so that the weight of the latch moves same to the unlatched position. In the latched position the notch 82 faces generally upwardly and in the unlatched position the notch 82 faces in a direction generally normal to the longitudinal axis of the post 3. A stop 84 is secured to the plate 72 and limits movement of the latch member 76 to its latched and unlatched positions. Preferably, the edge 81 and an edge of the plate 72 adjacent the edge 81 are positioned back from an edge 86 of the post 3 whereby a brace portion 88 of the gate 5 will be in contact with the edge 86 when the gate is in the closed position instead of the edge 81 and the plate 72 edge. Also, the edge 83 is positioned at a height so that when the gate 5 is in its final closed position, a portion of the weight of the gate 5 is supported on the edge 83 so as to prevent all of the weight of the gate 5 from being supported by the hinge means 4.

The latch means 6 also includes a second latch or lock member 90 which is also pivotally mounted on the plate 72 as, for example, by a suitable pivot pin 91. The latch member 90 is movable between the latched position and an unlatched position as seen in broken lines in FIG. 5 by the movement of the free end of the gate 5 when the brace 88 moves into contact with the latch member 90. Movement of the latch member 90 preferably is limited by stop means which in the illustrated structure includes an edge 92 of the plate 72 which is inclined relative to the vertical with the edge 92 being in cooperative engagement with a flange 93 of the latch 90. The relative positions of the flange 93 and the edge 92 limit the unlatched position of the latch 90 whereby an edge 94 is inclined upwardly and away from the post 3 whereby upon upward movement of the brace 88 engagement of same with the edge 94 urges the gate to move toward an open position in a positive manner. Means is provided which cooperate between the latch member 76 and the latch member 90 so as to releasably retain the latch members 76 and 90 in their latched positions. In the illustrated structure, an abutment 95 is provided in the flange 93 and is selectively engageable with the edge 81 and prevents pivoting movement of the latch 76 when the latch member 90 is in its latched position. Preferably, a resilient member such as a spring 96 cooperates with the latch member 90 to bias same to its latched position. Also, both the latch members 76 and 90 can be provided with openings 97 which are in alignment when the latch members 76 and 90 are in their latched position so as to provide a place to secure same in the latched position as, for example, by the use of a padlock with the shank portion thereof received through the openings 97. Preferably, when the latch member 76 is in its unlatched position, the arm 78 is inclined upwardly and away from the post 3 to facilitate closing movement of the gate 5 wherein when the brace 88 contacts the arm 78 the incline thereof facilitates the gate 5 moving the latch member 76 to its latched position.

In operation, raising of the free end of the gate 5 moves a brace 88 into engagement with the edge 94 which then in turn effects pivoting movement of the latch member 90 whereby the latch member 76, due to the position of the pivot 77, can under the influence of gravity move to its open position and further upward movement of the gate urges opening movement of the gate 5 by the inclination of the surface 94. After the brace 88 moves out of engagement with the edge 94, the latch member 90 returns to its latched position under the bias of the spring 96. Closing movement of the gate 5 brings the brace 88 into contact with the edge 81 thereby causing pivoting movement of the latch member 76 back to its latched position wherein the free end of the arm 78 contacts the flange 93 causing the latch member 90 to pivot slightly upwardly and upon completion of movement of the latch member 76 the arm 78 moves past the abutment 95 whereby the latch 76 is releasably retained in its latched position. Manual operation of the gate can also be accomplished as for example by having a pull chain 98 connected to the latch 90 for selectively moving same to the unlatched position.

Figure 7:
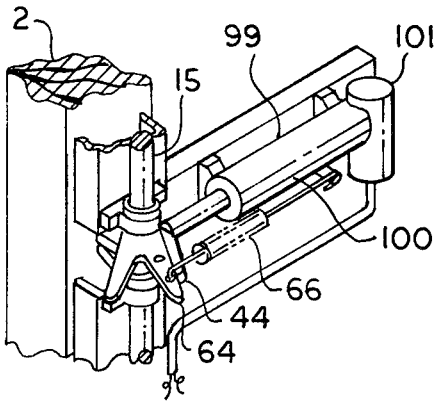
FIG. 7 shows a modified form of the structure showing a different type of motive means and actuator means.
Figure 8:
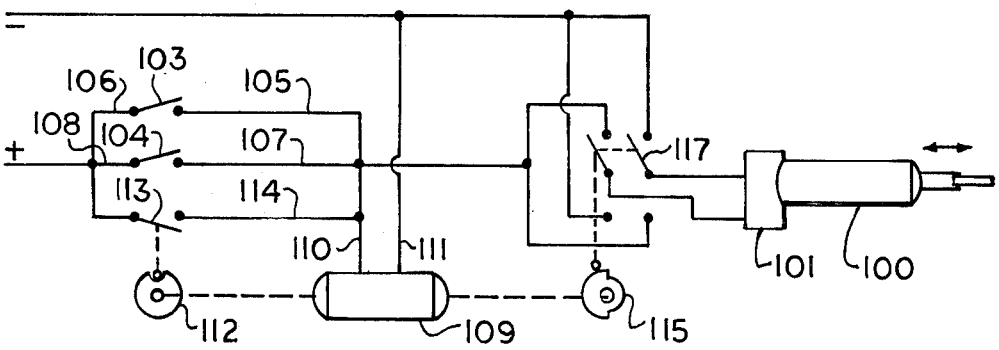
FIG. 8 is an electrical schematic for the modified form.

FIG. 7 shows a modified form of the present invention wherein the hinge means 4, gate 5, latch means 6 are basically the same as that shown and described for FIG. 1 wherein the difference between the two structures is in the actuator means and motive means. The actuator means 99 in the form shown is an electrically powered device which effects linear motion of the plate 44. In a preferred form of the electrically operated model, the actuator means is an electric motor 101 and worm gear drive screw wherein the worm gear drive screw is connected to the plate 44. The motor 101 when actuated causes extension by virtue of driving the worm gear drive 100 to effect reciprocal movement of the plate 44 as did the hydraulic member 33 and shaft 35. A version such as disclosed in this modified form is particularly advantageous when electric power is available at a position close to the gate structure 1. Another advantage of the electrically operated version is that because of the worm gear drive arrangement the gate will remain in an open position until the worm gear drive is retracted moving the plate 44 back to a gate closing position. The motive means in the modified form can take one or more forms. Switches 103 and 104 can be substituted in the ramp arrangement for the hydraulic members 49 whereby a vehicle passing over one of the ramps actuates either of the switches 103 and 104 depending upon which side of the gate 5 an object approaches the gate from. The energy transfer member in this case would be an electrical conductor which would include conductors 105 and 106 which electrically connect the switch 103 to the electric motor 101 and conductors 107 and 108 which electrically connect the switch 104 to the motor 101. This is best seen in the schematic illustrated in FIG. 8. The switches 103 and 104 are connected in parallel and are connected to a timing motor 109 by a conductor 110 with the motor 109 also being electrically connected to the other side of the power source by a conductor 111. Upon closing of either of the switches 103 or 104, the timing motor 109 is actuated and the timing motor has operably connected thereto a cam 112 which is operably associated with the switch 113 which is electrically connected in parallel to the switches 103 and 104 by a conductor 114. This system operates such that a momentary closing of either of the switches 103 or 104 effects operation of the timing motor and movement of the cam 112 which effects closing of the switch 113 for a timed cycle which maintains current flow to the motor 101 from the power source. After a predetermined time, the cam 112 opens the switch 113 thereby breaking the circuit between the power source and the motor 101. The motor 109 also has a second cam 115 operably associated therewith wherein the cam 115 is operably connected to a switch such as a double pole, double throw switch, that is suitably connected between the power source and the motor 101 to effect selective reversing thereof. The switch 117 is shown as a double pole, double throw switch whereby upon initial actuation of the motor 109 the switch is in one closed position so as to effect rotation of the motor 101 in one direction. After a preselected time as determined by the cam 115 and the rotation speed of the motor 109, the switch 117 is moved to a second position to reverse the polarity of the current flowing to the motor 101 and thereby reversing the direction of rotation thereof and movement of the worm gear drive screw in the opposite direction. It is to be pointed out that the cams 112 and 115 can be so contoured so as to effect a delay between the opening and closing movements of the gate by controlling the time between switching of the switch 117, thereby creating a delay in the reversing. Preferably, the motor 101 has an overload clutch whereby the worm gear drive screw can remain in an extended position while the motor 101 is still running and not damage the motor. It is also to be pointed out that this same opening and closing movement of the gate can be accomplished by the use of limit switches which are actuated by the motor 101 at the extended and retracted positions of the worm gear drive screw. A timer can be operably electrically connected to the limit switches so as to provide a dwell between the opening and closing movements. The limit switches would take place of the switch 117 to effect the reversing of the polarity thereof, the timer delaying the reversing of the polarity at the extended position of the worm drive screw.

Figure 9:
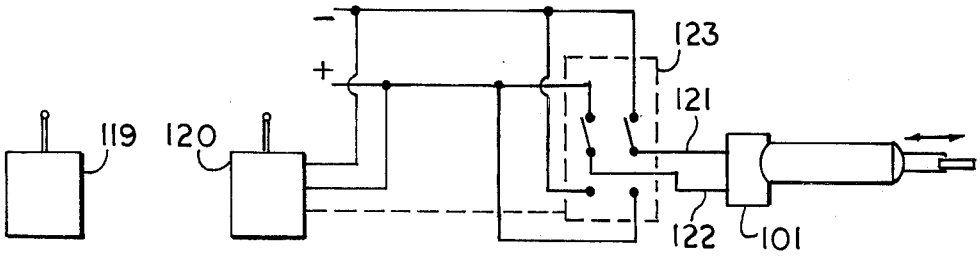
FIG. 9 is an electrical schematic of another modified form.

The switch arrangement as described above can be replaced in a second modified form, as seen in FIG. 9, by a remote control transmitter 119 and receiver 120 such as those used as garage door openers wherein a signal is transmitted by radio wave to the receiver from the sender which can be carried in a vehicle with the receiver being operably connected to the motor 101 by electrical conductors 121 and 122, the energy transfer, member which does not require movement for transfer of energy. The switch 123 can be a part of the receiver 120 or operated thereby as is known in the art. Operation of the gate structure in the electrically operated versions is basically the same as that disclosed for the hydraulically operated version.

It is to be understood that while we have illustrated and described certain forms of our invention, it is to be understood that same is not to be limited to the specific form or arrangement of parts herein described and shown.

What is claimed and desired to be secured by Letters Patent is:

1. A remotely operated gate comprising:

(a) a support;

(b) a gate member having opposite ends;

(c) hinge means cooperating with said support and one end of said gate member and hingedly mounting said gate member on said support, said hinge means including a plurality of hinge members in spaced apart relation and being movable relative to one another to selectively change the plane of the gate member whereby the gate member will move under the influence of gravity between open and closed positions;

(d) first means cooperating with said hinge members for effecting the relative movement therebetween, said first means including motive means with at least a portion thereof remote from said support and actuator means operably connected to said hinge means, said motive means being operably connected to said actuator means by an energy transmitting member which when transmitting energy is substantially immovable whereby operation of said motive means effects operation of said actuator means effecting the relative movement of said hinge members for effecting changing the plane of the gate member whereby said gate member moves between the open and closed positions; and (e) force applying means operably associated with said gate member, said force applying means including a movable member cooperating with said gate member and said actuator means whereby when said actuator means effects relative movement of said hinge members, said movable member is moved for applying force to said gate member to help start opening movement of said gate thereby assisting gravity induced opening movement.

2. The gate as set forth in claim 1 includes:

(a) a stop member positioned remote from said support and positioned to be adjacent the other end of said gate when said gate is in the closed position; and (b) latch means mounted on said stop member and adapted to releasably retain said gate member in the closed position.

3. The gate as set forth in claim 2 includes:

(a) second means operably associated with said gate member for delaying movement of said gate member from the open position to the closed position for a length of time sufficient for an object to pass the gate member in the open position.

4. The gate as set forth in claim 2 wherein:

(a) said hinge members are operable during relative movement therebetween for raising the other end of the gate member for releasing the latch means from retaining the gate member in the closed position.

5. The gate as set forth in claim 4 wherein said latch means includes:

(a) a latch member having a pair of spaced apart arms forming an opening therebetween for receiving a portion of the gate member adjacent the other end therein, said latch member is movably mounted on said stop member and is movable between a retaining position and a release position and when in the release position said opening faces generally away from said stop member and one arm has an edge partially defining said opening which is inclined downwardly and toward said stop member;

(b) a lock member movable between a latch position and an unlatched position and is movably mounted on said stop member, said lock member has a portion thereof engageable with a portion of said latch member for releasably retaining the latch member in the retaining position when the lock member is in the latch position, said lock member extends between free ends of the latch member arms when in the latch position and has an edge which slopes upwardly and away from the stop member when the lock member is in the unlatched position; and (c) stop means cooperating with said latch member and lock member and limiting movement thereof.

6. The gate as set forth in claim 4 wherein said hinge means includes:

(a) a pair of shafts rotatably mounted on said support and a plurality of hinge members each secured to a respective said shaft;

(b) said hinge members each have first and second arms in pivotal relation to one another with the first arms each being secured to a respective shaft and the second arms being secured to a portion of the gate member, said first arms are disposed at an angle relative to one another to extend in different radial directions in relation to the longitudinal axis of the respective shaft; and wherein (c) said shafts are operably connected to said actuator means whereby said actuator means effects rotation of said shafts and thereby relative movement of said hinge members.

7. The gate as set forth in claim 6 wherein:

(a) said shafts each have a third arm secured thereto extending outwardly therefrom and are disposed at an angle relative to one another and are operably connected to a movable portion of said actuator means whereby movement of said movable portion effects rotation of said shafts in opposite directions.

8. The gate as set forth in claim 7 wherein:

(a) said actuator means includes an extensible and retractable first hydraulic member carried by said support with a movable rod associated and movably mounted on said support with said third arms connected thereto whereby extension and retraction of said first hydraulic member effects rotation of said shafts, said actuator means also includes third means cooperating with said first hydraulic member for selectively urging retraction thereof;

(b) said motive means includes a pair extensible and retractable second hydraulic members each positioned on opposite sides of and remote from the support and positioned for operable engagement with an actuating object; and (c) said energy transmitting member including conduit means connecting said second hydraulic members to said first hydraulic members for flow of fluid therebetween.

9. The gate as set forth in claim 8 includes:

(a) a flow control valve connected in said conduit means for controlling the rate of fluid discharge from said first hydraulic member during retraction thereof thereby selectively delaying closing movement of said gate member.

10. The gate as set forth in claim 8 wherein said motive means includes:

(a) ramp means, said ramp means including a base member and a ramp with first and second ends with the first end being hingedly mounted on said base member for movement between a first position remote from the base member and a second position adjacent the base member with said base member and ramp having a respective second hydraulic member positioned therebetween whereby movement of said ramp toward said base member effects contraction of the second hydraulic member and thereby extension of the first hydraulic member; and (b) means cooperating with the base member and the ramp and limiting movement of the ramp to the first position.

11. The gate as set forth in claim 7 wherein:

(a) said actuator means includes an actuating member movably mounted on said support for generally linear movement with said third arms connected thereto and includes electrically powered means cooperating with said actuating member for selectively moving same; and (b) said motive means is operable for selectively allowing current to flow to said electrically powered means by operating a switch operably connected to said electrically powered means.

12. The gate as set forth in claim 11 wherein:

(a) said motive means includes switches each positioned remote from said support and at least one being positioned on opposite sides thereof and are selectively operable by an object, said switches are electrically connected to said electrically powered means by said energy transmitting member which includes electrical conductors whereby said switches selectively complete a circuit between a power source and the electrically powered means.

13. The gate as set forth in claim 12 wherein said second means includes:

(a) a timer means electrically connected to said electrically powered means and operable after a preselected time period for reversing said electrically powered means for moving said gate member from the open position to the closed position.

14. The gate as set forth in claim 12 wherein:

(a) said motive means includes a transmitter and receiver with said receiver being electrically connected to said electrically powered means at least partially by said energy transmitting member with said transmitter and receiver being operable for selectively allowing current to flow to a portion of said electrically powered means.

15. The gate as set forth in claim 1 wherein:

(a) said movable member is an arm member mounted for pivotal movement, said arm member has a portion engageable with said gate member; and including (b) means for cooperating with said arm member and operable for inducing pivotal movement of said arm member and thereby apply force to said gate member to positively urge the gate member to start closing movement thereby assisting gravity induced closing movement and opening movement.

16. The gate as set forth in claim 15 wherein:

(a) said means cooperating with said arm member includes a resilient member connected to said arm member operable for applying closing movement force.

17. The gate as set forth in claim 15 wherein:

(a) said means cooperating with said arm member includes a portion of said actuator means operable for selectively pivoting said arm member and apply force to said gate member to positively urge the gate member to start opening movement.

18. The gate as set forth in claim 17 wherein:

(a) said arm member has two arm portions with one arm portion being engageable with the gate member to apply the opening movement force and the other arm portion being engageable with the gate member to apply the closing movement force.

19. A remotely operated gate comprising:

(a) a support member;

(b) a stop member positioned remote from said support member;

(c) a gate member having first and second ends;

(d) hinge means cooperating with said support member and said gate member first end hingedly mounting said gate member on said support member wherein said gate member is movable between a closed position with said second end being adjacent said stop member and an open position with said second end being remote from said stop member, portions of said hinge means being movable for changing the plane of the gate member to effect the movement of the gate member and also raise the second end of the gate member when same is in the closed position;

(e) first means operably connected to said hinge means to effect movement thereof and thereby changing the plane of the gate member when same is in the open and closed positions and also operable for moving the portions of the hinge means so as to raise the second end of the gate member when same is in the closed position;

(f) a first latch member pivotally mounted on said stop member and movable between a latch position and an unlatch position and having first and second arms defining an opening therebetween adapted to receive a portion of the gate member therein for releasably retaining the gate member in the closed position when the first latch member is in the latch position; and (g) a second latch member movably mounted on said stop member and is movable between an unlatch position and a latch position and is operable to releasably retain said first latch member in its latch position when said second latch member is in its latch position, said second latch member being movable to its unlatch position by engagement with a portion of the gate member when the second end is raised.

20. The gate as set forth in claim 19 wherein:

(a) said first and second arms extend generally upwardly when said first latch member is in the latch position and said first and second arms extend generally away from said stop member when said first latch member is in the unlatch position, said first and second arms having free ends thereof spaced apart; and (b) said second latch member has an abutment engageable with one of said first and second arms for releasably retaining the first latch member in its latch position, said second latch member has a surface engageable with the gate member portion which when the second latch member is in the unlatch posittion the surface is inclined upwardly and away from the stop member for inducing movement of the gate member toward the open position during raising of the second end.

21. A remotely operated gate comprising:

(a) a support;

(b) a gate member having opposite ends;

(c) hinge means cooperating with said support and one end of said gate member and hingedly mounting said gate member on said support, said hinge means including a plurality of hinge members in spaced apart relation and being movable relative to one another to selectively change the plane of the gate member whereby the gate member will move under the influence of gravity between open and closed positions;

(d) first means cooperating with said hinge members for effecting the relative movement therebetween, said first means including motive means with at least a portion thereof remote from said support and actuator means operably connected to said hinge means, said motive means being operably connected to said actuator means by an energy transmitting member which when transmitting energy is substantially immovable whereby operation of said motive means effects operation of said actuator means effecting the relative movement of said hinge members for effecting changing the plane of the gate member whereby said gate member moves between the open and closed positions;

(e) a stop member positioned remote from said support and positioned to be adjacent the other end of said gate when said gate is in the closed position;

(f) latch means mounted on said stop member and adapted to releasably retain said gate member in the closed position, said latch means includes a latch member having a pair of spaced apart arms forming an opening therebetween for receiving a portion of the gate member adjacent the other end therein, said latch members movably mounted on said stop member and is movable between a retaining position and a release position and when in the release position said opening faces generally away from said stop member and one arm has an edge partially defining said opening which is inclined downwardly and toward said stop member, said latch means further includes a lock member movable between a latch position and an unlatch position and is movably mounted on said stop member, said lock member has a portion thereof engageable with a portion of said latch member for releasably retaining said latch member in a retaining position when the lock member is in the latch position, said lock member extends between free ends of the latch member arms when in the latch position and has an edge which slopes upwardly and away from the stop member when the lock member is in the unlatched position, said latch means further including stop means cooperating with said latch member and lock member and limiting movement thereof; and (g) said hinge members are operable during relative movement therebetween for raising the other end of the gate member for releasing the latch means from retaining the gate member in the closed position.

* * * * *